US011090525B2

(12) United States Patent
Hare et al.

(10) Patent No.: US 11,090,525 B2
(45) Date of Patent: Aug. 17, 2021

(54) VIRTUAL INERTIA ENHANCEMENTS IN BICYCLE TRAINER RESISTANCE UNIT

(71) Applicant: 4iiii Innovations Inc., Cochrane (CA)

(72) Inventors: Arthur William Hare, Kitchener (CA); Andrew James Michael Buckrell, New Hamburg (CA)

(73) Assignee: 4IIII INNOVATIONS INC., Cochrane (CA)

( * ) Notice: Subject to any disclaimer, the term of this patent is extended or adjusted under 35 U.S.C. 154(b) by 20 days.

(21) Appl. No.: 16/752,643

(22) Filed: Jan. 25, 2020

(65) Prior Publication Data

US 2020/0238129 A1 Jul. 30, 2020

Related U.S. Application Data

(60) Provisional application No. 62/797,039, filed on Jan. 25, 2019.

(51) Int. Cl.
*A63B 21/00* (2006.01)
*A63B 21/005* (2006.01)
(Continued)

(52) U.S. Cl.
CPC ..... *A63B 21/4049* (2015.10); *A63B 21/0052* (2013.01); *A63B 21/225* (2013.01);
(Continued)

(58) Field of Classification Search
CPC ..... H04M 1/725; G01S 19/19; G06F 3/011; G06F 19/3481; H04L 67/306;
(Continued)

(56) References Cited

U.S. PATENT DOCUMENTS 3,669,348 A * 6/1972 Thevis ..... G06C 7/10 235/60 R
4,082,265 A * 4/1978 Berkes ..... A63B 22/16 280/293

(Continued)

OTHER PUBLICATIONS

PCT/IB2020/000062 International Search Report and Written Opinion dated Jun. 18, 2020, 12 pp.

*Primary Examiner* — Garrett K Atkinson
(74) *Attorney, Agent, or Firm* — Lathrop GPM LLP

(57) ABSTRACT

A method and apparatus for detecting and varying indoor bicycle trainer pedaling resistance in varying manner to replicate the effects of increased system inertia. The method uses a high-resolution position detection method to correlate crank acceleration and deceleration to resistance level. The effects of inertia are replicated by limiting acceleration of the crank by application of increased resistance unit resistance and deceleration via reduction of the resistance applied to pedaling. Thus, the decreased magnitude of acceleration events imitates the effects an increased system mass (inertia) perceived by the rider, enhancing "road feel", which is synonymous with the feeling of accelerating one's own inertia while cycling outdoors. This is accomplished through sensors used to detect or determine crank position with a high resolution, a method of providing and varying resistance, such as an eddy current resistance device using either electromagnets or permanent magnets and a microcontroller to calculate the required magnetic field strength and adjust the field strength or magnet position in the resistance unit to facilitate the change required as determined by the outlined algorithm.

20 Claims, 9 Drawing Sheets

(51) Int. Cl.
*A63B 21/22* (2006.01)
*A63B 23/04* (2006.01)

(52) U.S. Cl.
CPC ..... *A63B 21/4034* (2015.10); *A63B 23/0476* (2013.01); *A63B 2220/34* (2013.01); *A63B 2220/44* (2013.01); *A63B 2220/78* (2013.01); *A63B 2220/805* (2013.01); *A63B 2220/833* (2013.01)

(58) Field of Classification Search
CPC .... H04L 67/38; G06Q 10/0639; G06Q 50/22; A63B 24/0087; A63B 21/22; A63B 21/00069; A63B 21/4035; A63B 21/4034; A63B 23/03516; A63B 22/0605; A63B 2220/34; A63B 2220/51; A63B 21/0051; A63B 2230/06; A63B 2071/065; A63B 21/015; A63B 2220/17; A63B 2220/20; A63B 2220/64; A63B 2225/09; A63B 2225/093; A63B 2225/50; A63B 21/0552; A63B 2024/009; A63B 2022/0611; A63B 2024/0096; A63B 2024/0093; A63B 21/4049; A63B 21/0052; A63B 21/225; A63B 2220/833; A63B 2220/44; A63B 2220/78; A63B 2220/805; A63B 23/0476; A63B 2069/165; A63B 69/16; A63B 2220/40; A63B 2220/80; A63B 71/0622; A63B 2071/0638; A63B 2022/0641
See application file for complete search history.

(56) References Cited

U.S. PATENT DOCUMENTS 4,146,001 A * 3/1979 McCarthy ..... F02P 5/15 123/406.59
4,378,111 A * 3/1983 Tsuchida ..... A63B 24/00 482/54
4,866,268 A * 9/1989 Tang ..... F02D 41/009 250/231.18
5,240,417 A * 8/1993 Smithson ..... A63B 21/00181 434/61
5,480,366 A * 1/1996 Harnden ..... A63B 69/16 482/57
5,774,196 A * 6/1998 Marshall ..... H04N 5/7458 348/743
6,126,571 A * 10/2000 Parks ..... A63B 69/16 434/247
6,285,024 B1 * 9/2001 Pinnock ..... G01D 5/2492 250/231.13
6,492,963 B1 * 12/2002 Hoch ..... B62J 6/20 340/432
8,410,622 B1 * 4/2013 Wallach ..... F03D 7/06 290/44
8,801,569 B2 * 8/2014 Petron ..... B60W 20/10 477/16
9,191,038 B2 * 11/2015 Abe ..... G08C 17/00
9,393,483 B2 * 7/2016 Tan ..... A63C 17/12
10,144,247 B2 * 12/2018 Joso ..... B60G 13/08
10,285,649 B1 * 5/2019 Murray ..... A61B 5/4866
10,527,408 B2 * 1/2020 Hara ..... B60B 31/02
2002/0055422 A1 * 5/2002 Airmet ..... A63F 13/06 482/61
2007/0188587 A1 * 8/2007 Kwasny ..... G11B 7/0037 347/224
2011/0222385 A1 * 9/2011 Lai ..... G11B 7/0037 369/53.11
2011/0299376 A1 * 12/2011 Ouchida ..... G11B 23/40 369/100
2013/0130798 A1 * 5/2013 Nir ..... A63F 13/245 463/36
2013/0157804 A1 * 6/2013 Petron ..... B60W 20/10 477/3
2015/0290490 A1 * 10/2015 Badarneh ..... A63B 22/0025 482/6
2017/0349003 A1 * 12/2017 Joso ..... F16F 15/002
2018/0306572 A1 * 10/2018 Hara ..... B60B 31/02

* cited by examiner

VIRTUAL INERTIA ENHANCEMENTS IN BICYCLE TRAINER RESISTANCE UNIT

RELATED APPLICATIONS

This application claims priority to U.S. Provisional Patent Application No. 62/797,039, filed Jan. 25, 2019 and titled "Virtual Inertial Enhancements in Bicycle Trainer Resistance Unit", the entirety of which is incorporated herein by reference.

BACKGROUND

When exercising using a stationary bike trainer (e.g., a bicycle, a permanent stationary bicycle, a spin bike, etc.), the rider experiences the effects of inertia when trying to accelerate or decelerate the resistance-generating mechanism. This inertia is often referred to as "road feel", and is analogous to replicating the mass of a rider while trying to accelerate or decelerate when biking outdoors. It is often desirable to have an inertial loading approaching, or even exceeding, what would be felt on the road for a rider. When there is insufficient inertia, the change in speed of the crank provides an unrealistic feeling, and is often likened to the experience of riding in mud.

In the construction of bicycle trainers, or more specifically "smart" trainers with a method for dynamically adjusting the exercise loading, inertial loading is often accomplished with the use of a flywheel mass, often geared to rotate at a higher speed than the rotational speed of the rear wheel of the bicycle would otherwise be. This effectively increases the inertial loading. However, the additional mechanism and mass adds weight, complexity, noise and cost to the trainer assembly.

SUMMARY OF THE EMBODIMENTS

The present embodiments include a method for controlling the resistance applied to a stationary bike trainer, or spin bike, to replicate the inertial effects of a system with increased mass or rotational speed. The present embodiments temporally manipulate the resistance provided by a resistance mechanism to simulate the dynamic effects of inertia, which may be defined using Newton's second law of motion. This method effectively adds a component of virtual inertia, thereby replicating the resistance to rotational accelerations without adding mass (or inertia, whereby the same mass is redistributed to increase the rotational moment of inertia I) to the system, and without incurring the complexity increase seen with addition of an external flywheel or wheel weights. In this context, a force represented by the term $I\alpha$ as a resistance of angular acceleration to an externally applied torque, is applied to a force balance and used to resist changes to angular velocity throughout the pedal stroke of a user. This can be represented using Newton's second law of motion, applied for rotating objects:

$$T=I\alpha. \tag{1}$$

In Eqn. 1, T is the torque, I is the rotational inertia, and $\alpha$ is the rotational acceleration. Eqn. 1 can be further expressed using an additional term for supplemental torque, to equate to a more massive (i.e., higher inertia) system. This is represented by:

$$T_{rider}=T_{desired,1}+[I_1\alpha_1]=T_{desired,2}+[I_2\,\alpha_2+T_{supplemental}] \tag{2}$$

In Eqn. 2, $T_{rider}$ is the torque felt through the pedals of the bicycle, $T_{desired,n}$ is the nominal requested or required torque applied through the resistance unit, and $T_{supplemental}$ is the time-dependent component of torque used to replicate the effects of increased inertia. In Case 1 (with a subscript denoted "1"), the trainer does not actively compensate the response torque, and in Case 2, $T_{supplemental}$ is used to compensate the effects of additional inertia. Case 1 and Case 2 are presumed to be equivalent, since the torque $T_{rider}$ felt by the rider should be equal in both cases. It is assumed that $T_{desired,1}$ and $T_{desired,2}$ are equal, and that $I_2 \gg I_1$.

Assuming $\alpha_1=\alpha_2$, Eqn. 2 may be rearranged such that:

$$T_{supplemental}=(I_1-I_2)\alpha. \tag{3}$$

The torque $T_{supplemental}$ can be dynamically adjusted (e.g., by a control unit) to increase resistance during acceleration events, thereby limiting the magnitude of acceleration, and decreasing resistance during deceleration events, thereby limiting the magnitude of deceleration. The overall impact of this dynamic variation of resistance is to reduce the amplitude of acceleration and deceleration, thus reducing the variation in pedaling cadence throughout a pedal stroke. The reduced variation is equated to "road feel". Furthermore, the control system used to replicate this actual inertia I, with a virtual or simulated inertia, adapts to changing riding conditions from the user, and adjusts the resistance requirement of the trainer resistance unit, providing a road feel which approaches that of a heavier flywheel system.

To facilitate proper operation of the system, a high-resolution cadence measurement source may be used to measure or rapidly detect changes in the pedal rotational speed, indicating an acceleration or deceleration of the system rotational speed and requirement for adaptation of the dynamic resistance adjustment. This acceleration is counteracted by manipulating the total system resistance, which may be used with a priori knowledge of the inertia characteristics of the system to further enhance the ability to correct or counteract these changes in pedal speed.

High-resolution cadence data may also be inferred from capturing wheel-speed data via an encoder or dynamic characterization of the wheel-spoke pattern, when combined with a method to sense the spokes passing a reference point, and assuming a fixed gear ratio to the pedals for some amount of time.

Facilitation of the dynamic resistance may be aided by generation of a measured, calibrated, or dynamically generated model of resistance as a function of input, where input could equally refer to: electrical current for an electromagnet, position of a magnetic resistance mechanism, or condition of a fluid resistance mechanism. These models may be produced by factory calibration, in the case of "wheel-off" or fluid-type trainers, or direct strain feedback, in the case of permanent magnet or electromagnet eddy current trainers.

In accordance with an embodiment of the virtual inertia method, the use of wheel-spoke spacing and location to provide high-resolution cadence data requires the ability to dynamically learn the exact spoke spacing, as measured by a sensor placed near the driven wheel of the bicycle. An algorithm for the detection and learning of this is provided in FIG. 1. In this algorithm, an index is required to signal the location of the first spoke. The timing between each spoke is measured, and it is assumed a constant wheel velocity exists for the entire rotation. This results in an angular model for each spoke, as well as a count of the spokes in a wheel. As the wheel makes a second rotation, the timing of each spoke is again measured, but the relative acceleration or deceleration is used to determine the timing of each spoke passing the sensor, and further refine the error bounds on the angular model of the wheel. For each revolution, an averaging method is performed, which increases certainty in the angular position of each of the spokes. This methodology continues to operate and refine the estimates throughout operation of the device, thus improving certainty of the exact wheel position and acceleration at any given point.

In accordance with an alternate embodiment of the virtual inertia method, variations in spoke spacing may be measured to provide an index reference for the wheel. Geometric features, such as valve stem location, or a user provided estimate or calculation of spoke count may be used to further refine the method. It is understood that the term "wheel" is used, but this method may be equally applied to flywheel or any other driven part of a bicycle trainer apparatus, including crank, chain or external flywheel. This list is illustrative, and not restricted. Additional measurement locations are envisioned.

In accordance with yet another alternate embodiment of the virtual inertia method, an accelerometer detecting exact crank position may be used to calculate timing requirements of the resistance manipulation.

In accordance with yet another alternate embodiment of the virtual inertia method, an encoder (e.g., magnetic, optical or otherwise) detecting exact crank position may be used to calculate timing requirements of the resistance manipulation.

In accordance with an example embodiment of the present disclosure, a traditional "wheel-off" bike trainer using an eddy current braking mechanism, generated by either electromagnets or permanent magnets may be adjusted to enhance virtual inertia. In this system, the rider affixes the bike to a system replacing the rear wheel, as shown in U.S. Pat. No. 5,480,366. While pedaling, a direct mechanical connection exists between the bike and resistance generating mechanism. By using the aforementioned virtual inertia timing algorithms, the electromagnetic resistance applied to the flywheel may be applied in accordance with the requirements for meeting the requirements of increased inertia. The term electromagnetic resistance is used, but it is understood that this could be equally applied to permanent magnet, fluid or other styles of resistance mechanisms used for bicycle trainers known in the art.

DETAILED DESCRIPTION OF THE EMBODIMENTS

Figure 1:
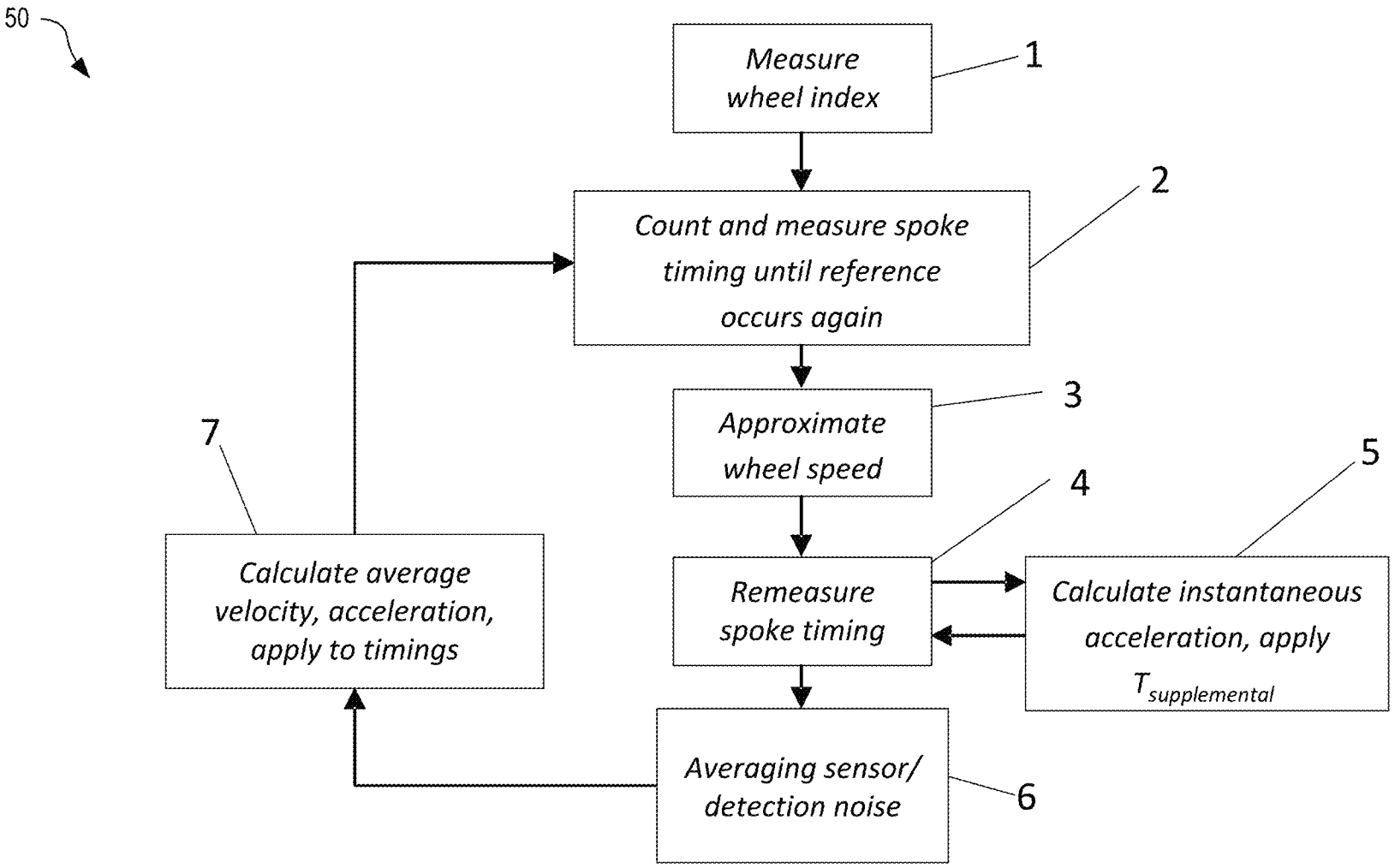
FIG. 1 is a block diagram of a spoke detection algorithm for an indexed wheel. In this image, the block diagram schematically represents the process used to determine the spacing or spokes, as detected by the spoke sensor.

FIG. 1 is a flow chart of a method 50 for detecting and compensating for acceleration and deceleration events in the context of a variable resistance mechanism. In a block 1 of the method 50, a wheel index reference position is measured by a secondary means, such as a spoke magnet or other means to identify the first spoke considered for a rotation. In a block 2 of the method 50, a spoke sensing device 100 counts the spokes until the next index is detected, characterizing a total number of spokes 101 in the wheel 102 (see FIG. 3). In a block 3 of the method 50, the wheel speed is approximated by dividing the circumference of the wheel by the number of spokes and the time interval measured between spokes. Initially, acceleration cannot be compensated until the spoke spacing is determined with a higher level of certainty, so in a block 6 of the method 50, an averaging algorithm is used to take successive measurements and empirically determine the spoke spacing while removing sensor noise and uncertainty. In a block 7 of the method 50, an average acceleration for the wheel over a full rotation is determined while the spoke pattern is reconstructed with increasing certainty. This pattern is continuous and may run for the entirety of operation, or may be terminated after uncertainty criteria are met.

As the wheel continues to rotate, the method 50 may calculate smaller accelerations, as determined by a change in timing between successive spokes 101 (as remeasured during a block 4 of the method 50). This acts as a high-resolution encoder, offering a convenient way of encoding exact crank movements. This methodology may be extended to detect any pattern of spokes, or events on any type of flywheel, whether it is a bicycle wheel or a flywheel-based resistance unit, driven by a bike chain.

Figure 2:
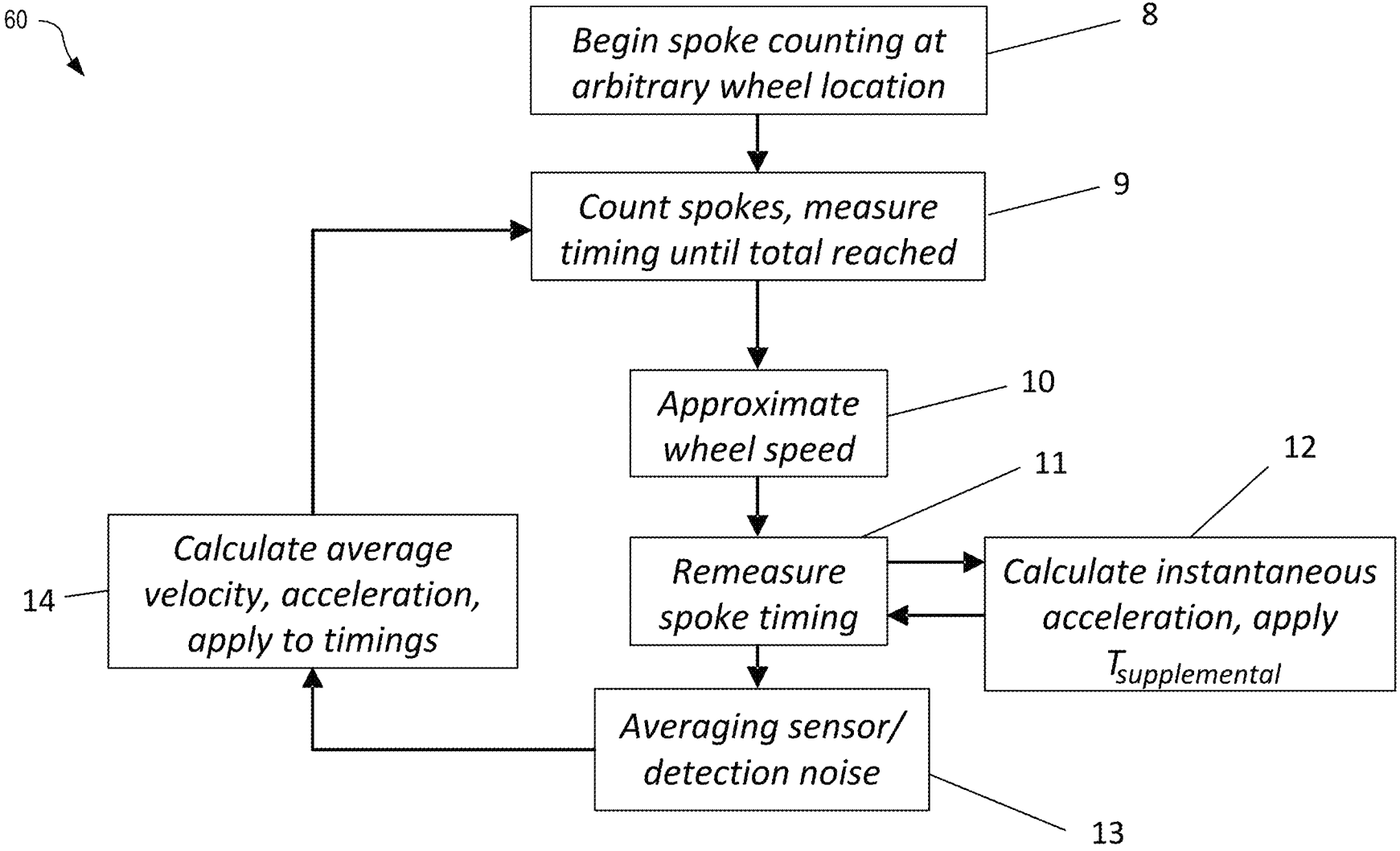
FIG. 2 is a block diagram of a spoke detection algorithm, without using an indexed rotation. The block diagram represents how the wheel is measured without an index or reference at the start of each rotation.

FIG. 2 shows a flow chart of a method 60 that is similar to the method 50 of FIG. 1, except that it may begin at an arbitrary spoke 101. In a block 9 of the method 50, the counting of spokes 101 and measurement of time continue simultaneously until a number of counted spokes equals a total number of spokes inputted (e.g., by a user), The result of block 9 is a preliminary timing map. In a block 10 of the method 50 during the following rotation, the speed is approximated using the spacings measured, and in a block 12 of the method 50, accelerations and decelerations are calculated. In a block 13 of the method 50, the spoke measurements are averaged to remove noise and uncertainty from the timing map. In a block 14, average velocity and acceleration over the course of a single full rotation are used to aid in this process. As with the method 50 of FIG. 1, the method 60 may continue throughout operation.

Figure 3:
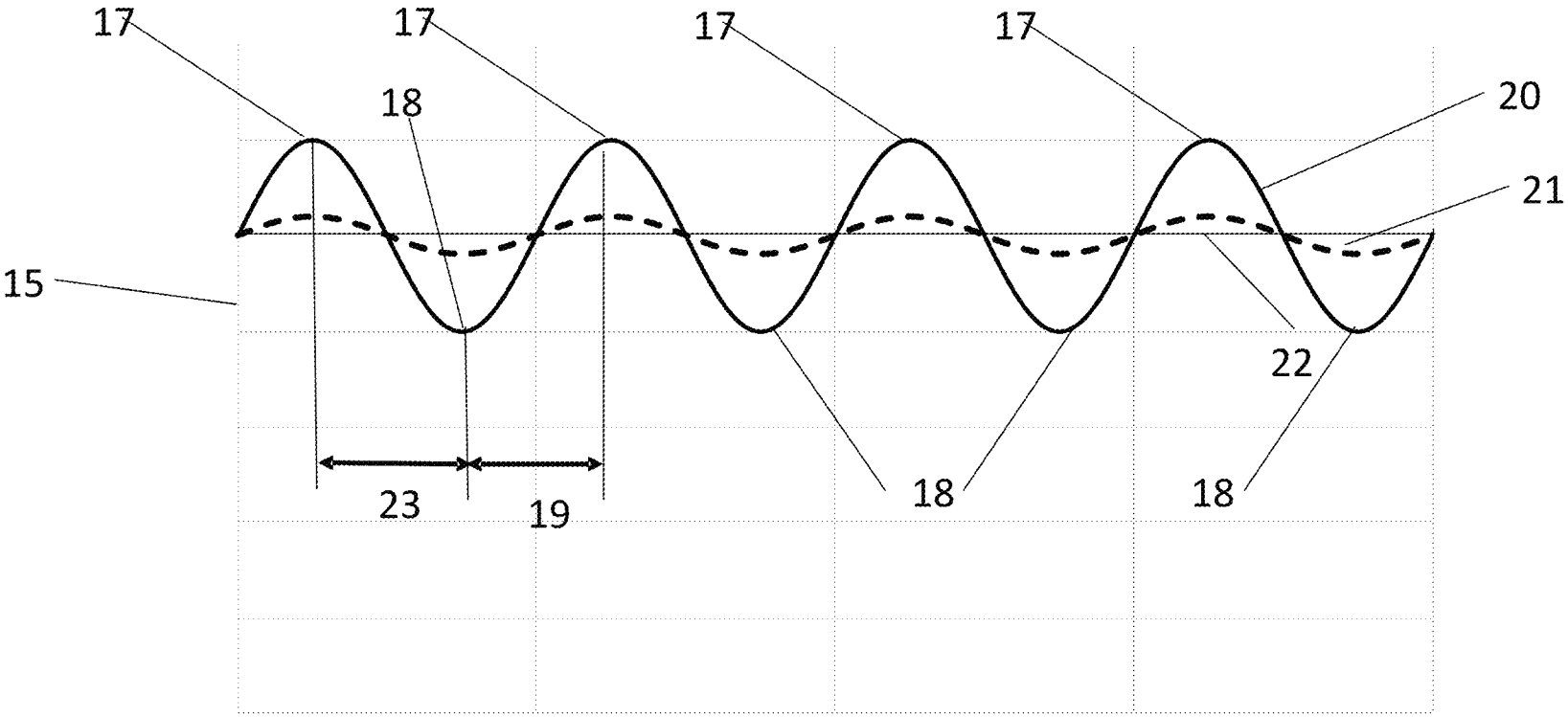
FIG. 3 is an exemplary view of typical wheel speed variation experienced by a cyclist during several crank revolutions. Different lines are drawn for a high-inertia system with small-speed variation amplitude, and a low-inertia system with high-speed variation amplitude.

FIG. 3 is a plot of wheel-speed variation throughout several pedal strokes. A y axis 15 shows wheel speed and an x axis 16 refers to pedal rotations. For each pedal rotation, the downward portion of the stroke typically corresponds to the highest strength of most cyclists, meaning the wheel may typically accelerate and reach a peak velocity 17. While the crank continues to rotate and one foot passes through the bottom of the pedal stroke, the foot decelerates 23, reaching a minimum velocity 18. As the crank continues to rotate, the alternate leg subsequently enters the downward movement phase, and the wheel reaccelerates 19. The lines in this chart correspond to crank rotational velocity with a low inertia condition 20 (i.e., the solid line) with large changes in velocity, and a high inertia condition 21 (i.e., the dashed line) with small changes in velocity. With infinite inertia, the curve becomes a flat line 22, as an infinitely large mass may not accelerate or decelerate regardless of the external forces applied. The intent of this invention is to replicate high inertia 21 or infinite inertia 22 with a system possessing the mass and configuration of a low inertia 20 system.

Figure 4:
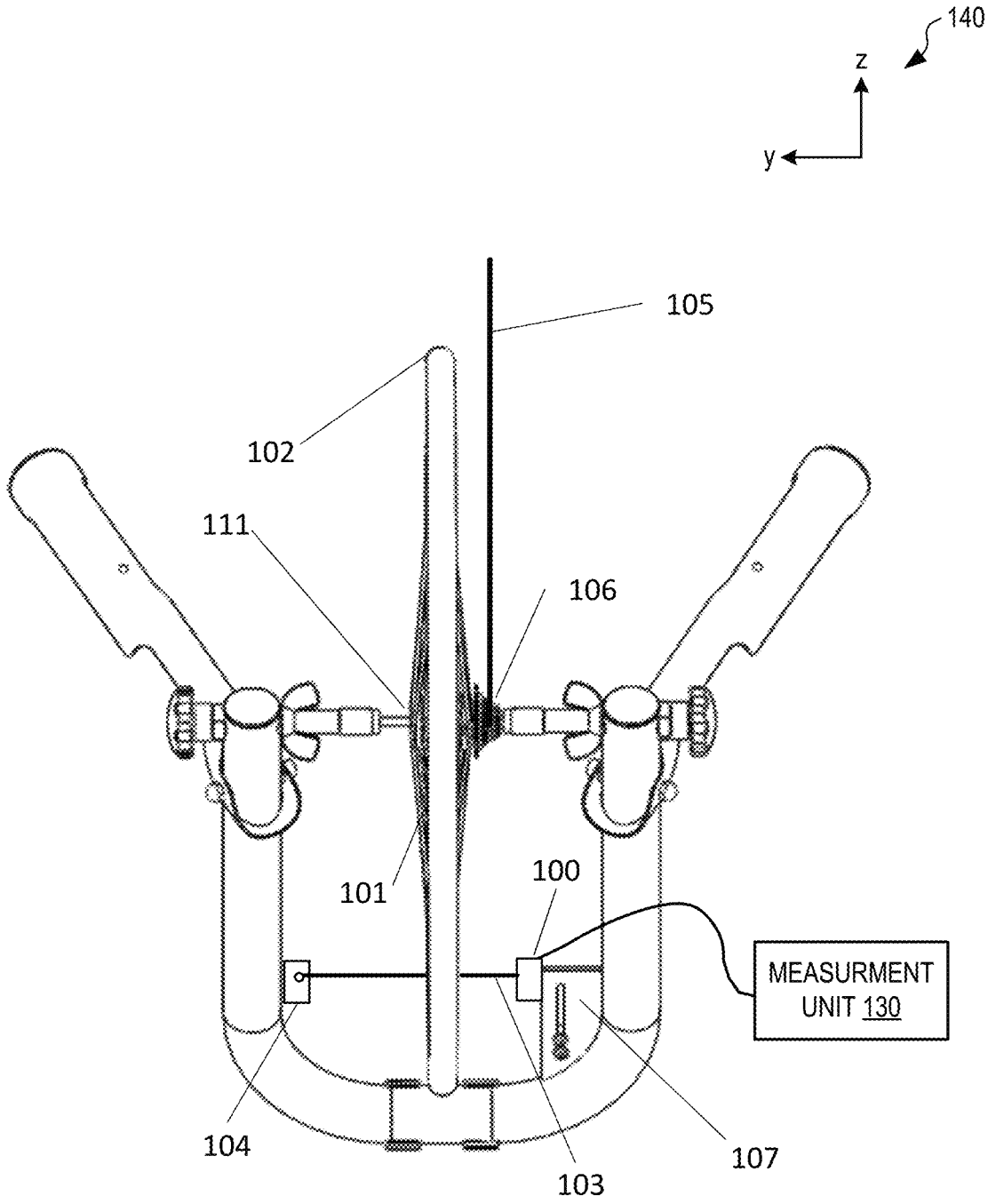
FIG. 4 is an exemplary view of a spoke measurement system, using an interrupted beam to detect the passing of each spoke.

Further referring to FIG. 4, the spoke detection methodology is demonstrated. A bicycle is mounted in an indoor trainer frame 110 at the rear axle 111. A spoke sensing device 100 is mounted to a fixed reference point or support frame 107, and detects a photo-interrupter beam 103 emitted by a light source 104. A measurement unit 130 records the time when the photo-interrupter beam 103 is blocked by each spoke 101. As the cyclist rotates the crank, the drive chain 105 transmits the force to a chain cog or cassette 106 (also referred to herein as "drive cog 106"), and the wheel 102 accelerates and decelerates as varying torque levels are applied to the bicycle pedals. It is understood that the wheel 102 is representative of the resistance generating device, and may equally refer to a chain driven resistance unit, by attaching the drive chain 105 to a separate chain driven device with drive cog 106. The wheel 102 is also representative of any flywheel or encoder device which may be used to provide inertia or may be used to generate resistance.

In other embodiments, a hall effect sensor detects spoke location instead of a photo-interrupter. A further embodiment not shown may use a reflective sensor to detect spoke location instead of a photo-interrupter. Another further embodiment not shown may use a plurality of spoke magnets 112 attached to spokes to identify one or more of the spoke locations each rotation. Another further embodiment not shown may use a reflective sensor to determine the reflection of an optical beam projected onto the spokes, and detected by a receiver mounted axially away from the spokes, relative to the rear axle of the bicycle.

Figure 5:
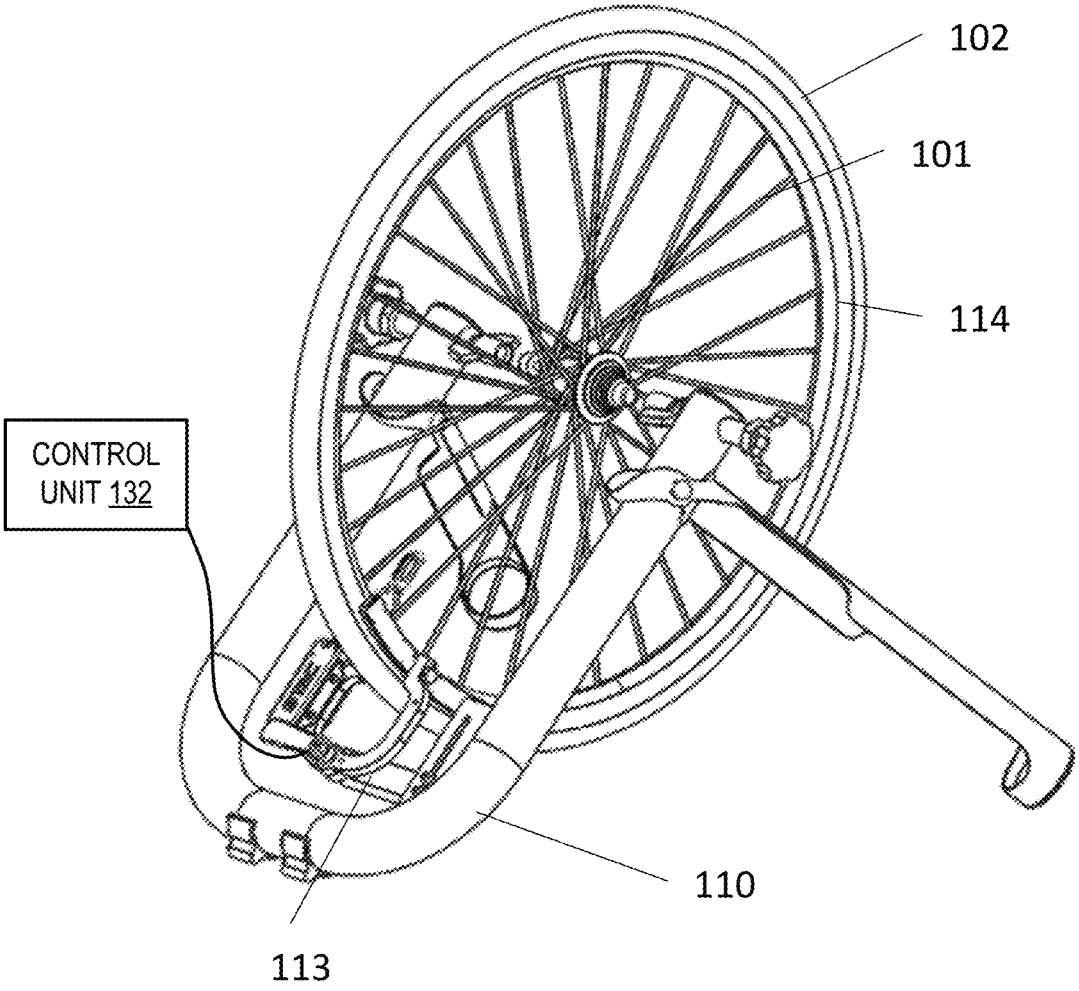
FIG. 5 is an exemplary view of the movement of a permanent magnet-based resistance unit, with a relative field strength B, dynamically manipulated at the surface of the spinning conductor used to generate resistance.
Figure 6:
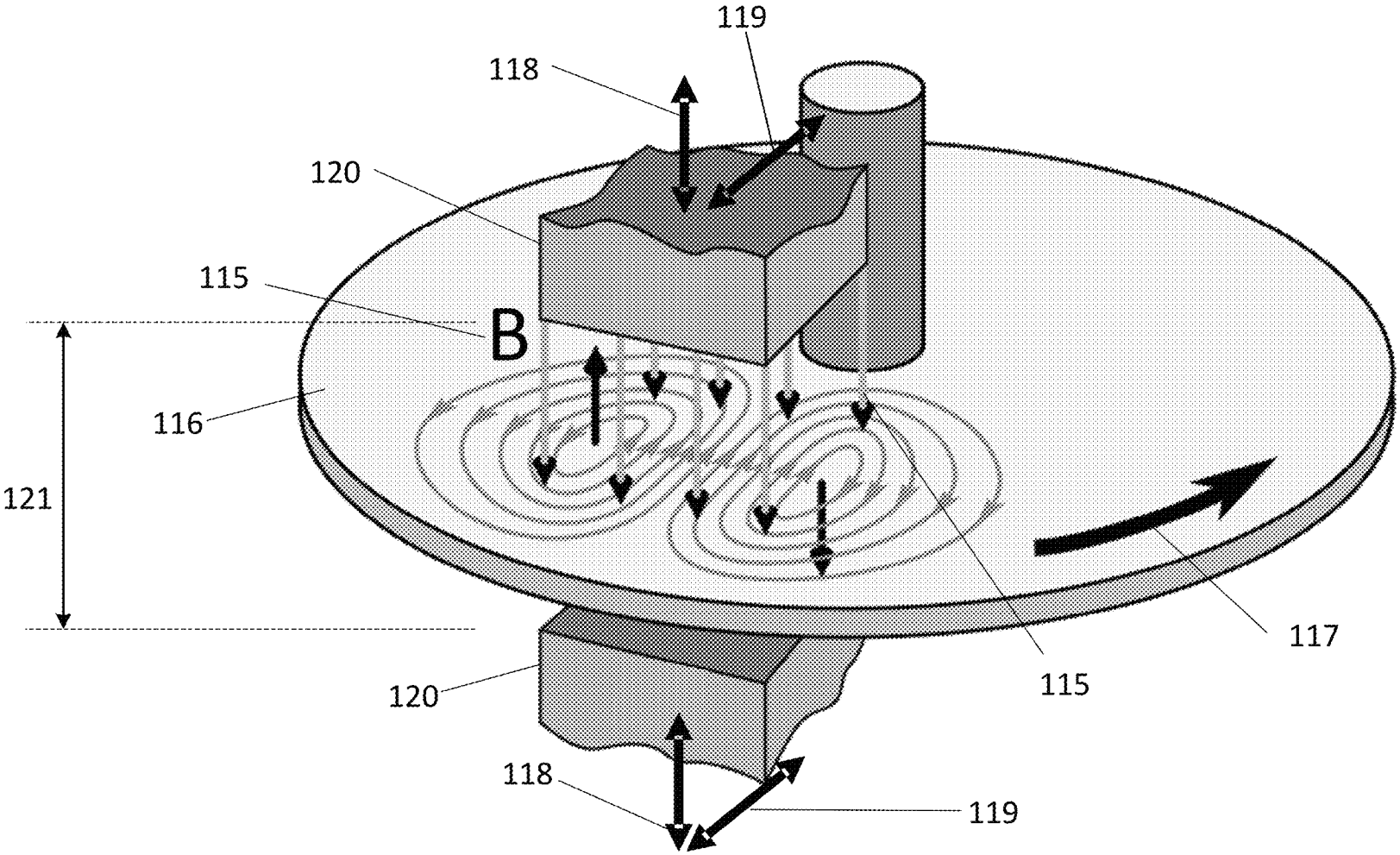
FIG. 6 is a schematic representation of a magnet (electromagnet or permanent) in proximity to a rotating conductive flywheel. The magnetic field B may be manipulated by variation of electrical current provided to the electromagnet, or by location of a permanent magnet to dynamically adjust the resistance level.

FIGS. 5 and 6 show a permanent-magnet-based resistance unit 113 acting on an aluminum rim surface 114 to provide a retardation force. When combined with the calculated acceleration or deceleration of the wheel, the strength B of the magnetic field 115 acting on the aluminum may be manipulated by adjusting a magnet spacing 121. At a large spacing 121, little retardation force is provided, while at a small spacing, significant retardation force is provided. Dynamic manipulation of the spacing may be controlled to coincide with acceleration phases 19 or deceleration phases 23 of the crank rotation. The magnitude of acceleration or deceleration may be calculated with a microcontroller (e.g., see processor 162 in FIG. 7), and the desired spacing is applied.

Referring further to FIGS. 5 and 6, an alternate embodiment not shown replaces the permanent magnet based resistance unit 113 with an electromagnet based resistance unit, in which the field strength B may be manipulated by either adjusting the position or electrical current provided to the electromagnet.

Referring further to FIGS. 5 and 6, an alternate embodiment not shown uses a combination of the permanent-magnet-based resistance unit 113 supplemented with an electromagnet for control of the field strength B.

Referring to FIG. 6, a detailed schematic view of the eddy current braking method is shown. The magnetic field 115 acts on the rotating disc 116, analogous to a bicycle wheel 102 or other electrically conductive flywheel, providing a retardation force. The retardation force acts in the direction opposite the rotation direction 117, thus slowing the rotational speed of the flywheel 116 (or wheel 102). The magnetic field strength B of the magnetic field 115 is dynamically manipulated based on the control system requirements by either moving the magnets 120 closer to the disc, in an axial direction 118, moving the magnets in a radial direction to reduce the effective torque acting on the disc 116, or intensifying the magnetic field B, by manipulating the current supplied to an electromagnet. It is understood that the axial movement 118 and radial movement 119 apply equally to both permanent magnet and electromagnetic devices, while manipulation of supply current applies only to electromagnetic devices.

Figure 7:
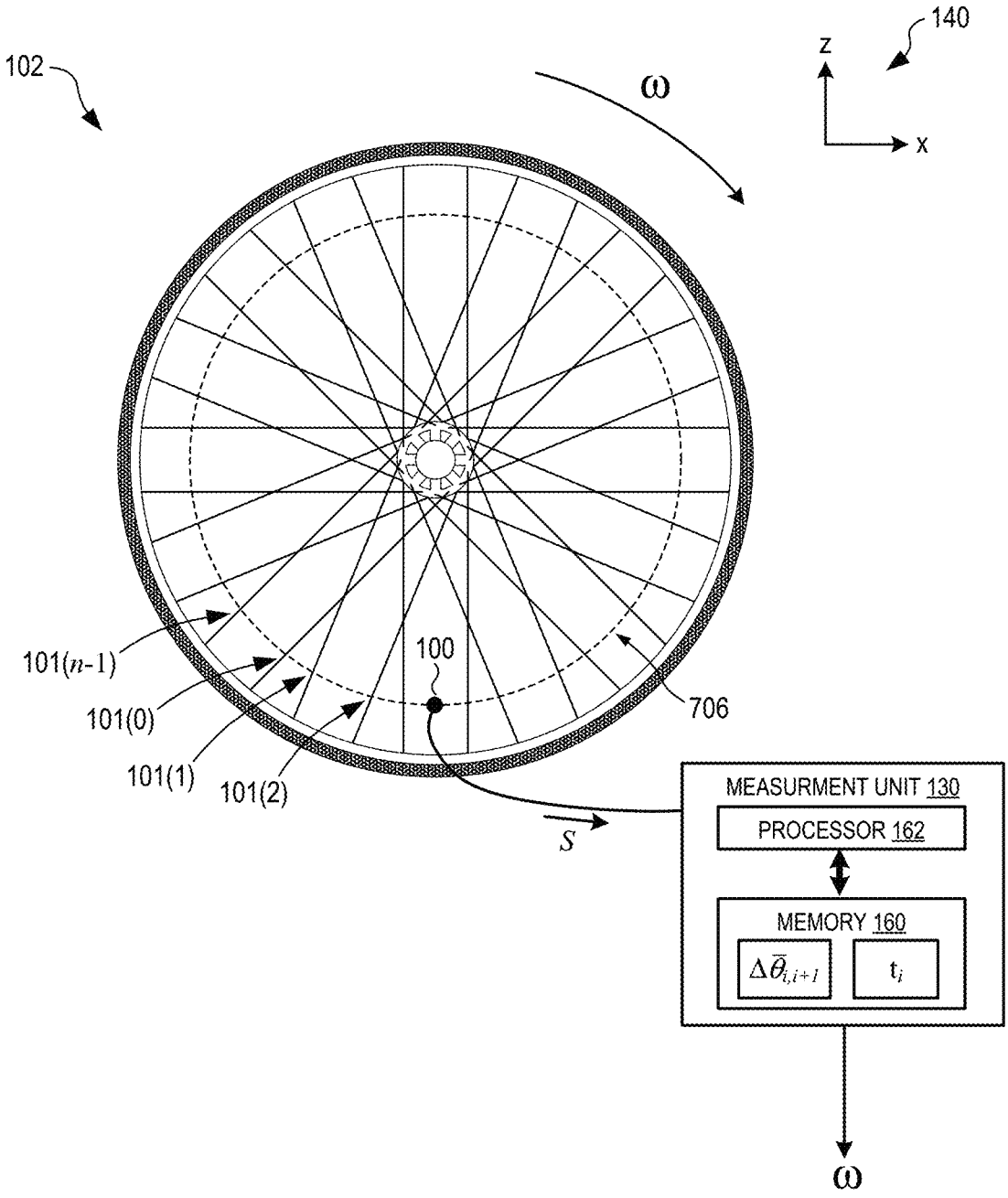
FIG. 7 is a side view of the wheel of FIG. 4 illustrating the method of FIG. 1 in more detail, in embodiments.
Figure 8:
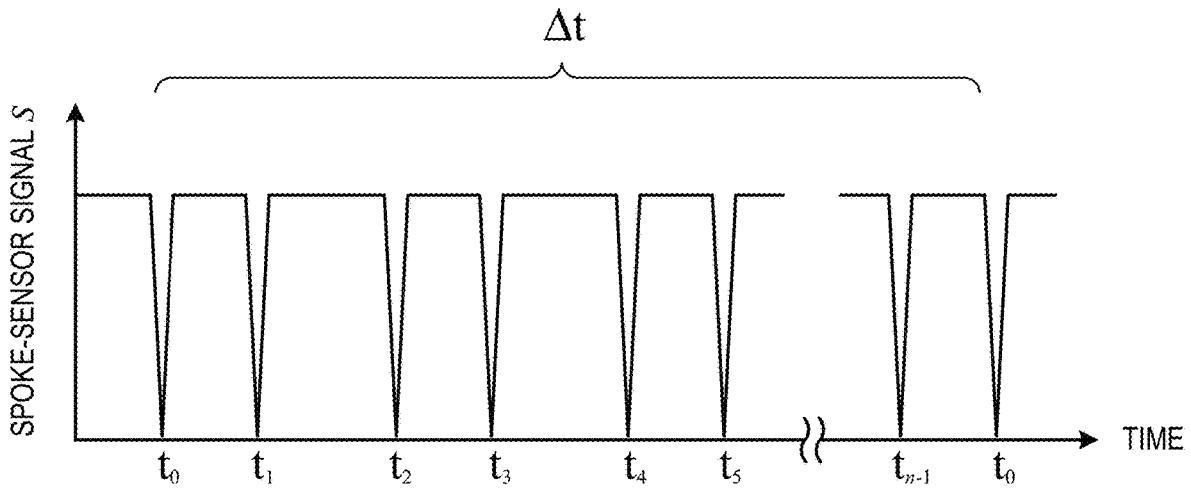
FIG. 8 is a plot of a spoke-sensor signal S, as a function of time, outputted by the spoke sensing device of FIG. 7 as the wheel rotates, in an embodiment.

FIG. 7 is a side view of the wheel 102 of FIG. 4 illustrating the method 50 in more detail. FIG. 8 is a plot of a spoke-sensor signal S, as a function of time, outputted by the spoke sensing device 100 as the wheel 102 rotates. FIGS. 7 and 8 are best viewed together with the following description:

In FIG. 7, the wheel 102 rotates at an angular velocity ω in a rotational plane that lies parallel to the x-z plane (see right-handed coordinate system 140). In general, the angular velocity ω can change in time as the wheel 102 is angularly accelerated and/or decelerated. The rotational axis of the wheel 102 is parallel to the y direction. FIG. 7 also shows a circular path 706 that indicates which part of the spokes 101 interrupt the photo-interrupter beam 103 (see FIG. 4) to generate the spoke-sensor signal S. The spokes 101 need not have uniform spacing. While FIG. 7 shows the wheel 102 with n=32 spokes, the wheel 102 can have any number of spokes 101 laced in any pattern without departing from the scope hereof.

The measurement unit 130 includes a processor 162 that communicates with a memory 160. Although not shown in FIG. 7, the memory 160 stores machine-readable instructions that, when executed by the processor 162, implement the functionality described herein. Specifically, the measurement unit 130 communicates with the spoke sensing device 100 to receive the spoke-sensor signal S. The measurement unit 130 then processes the spoke-sensor signal S to determine an initial spoke time $t_0$ at which a reference spoke 101(0) breaks the photo-interrupter beam 103. The measurement unit 130 determines the initial spoke time $t_0$ by observing a dip in the spoke-sensor signal S, as shown in FIG. 8. The spoke-sensor signal S dips again at a first spoke time $t_1$ at which a first spoke 101(1) breaks the photo-interrupter beam 103. This process continues, and eventually the spoke-sensor signal S dips at a spoke time $t_{n-1}$ at which a last spoke 101(n-1) breaks the photo-interrupter beam 103. When the reference spoke 101(0) again breaks the photo-interrupter beam 103 during the next rotation, the measurement unit 130 identifies that a full rotation of the wheel 102 has completed. Using an internal timer, the measurement unit 130 also measures a rotation time of T for the full rotation, based on the subsequent detections of the reference spoke 101(0).

Based on the measured spoke times, the measurement unit 130 calculates time intervals between neighboring spokes 101. Specifically, the measurement unit 130 calculates $\Delta t_{t,i-1}=t_i-t_{i-1}$ for i=1 to n (where $t_n$ is the same as $t_0$ for the subsequent rotation). The measurement unit 130 may then divide each of these n intervals $\Delta t_{i,i-1}$ by the rotation time T to obtain n corresponding angular widths $\Delta\theta_{i,i-1}$. Each angular width $\Delta\theta_{i,i-1}$ represents a fraction of a full rotation, and thus corresponds to an effective angle subtended by the spokes 101(*i*) and 101(i-1). The sum of the angular widths for a single rotation equals one, i.e., $\Sigma_{i=1}^{n}\Delta\theta_{i,i-1}=1$. The collection of angular widths $\Delta\theta_{i,i-1}$ is the timing map referred to previously.

The process shown in FIGS. 7 and 8 may be completed for several subsequent rotations of the wheel 102 to improve accuracy of the timing map. For a first rotation of the wheel 102, the measurement unit 130 may simply count the number n of spokes 101 based on the dips in the spoke-sensor signal S. The measurement unit 130 may then allocate n slots in the memory 160, one for each of the angular widths $\Delta\theta_{i,i-1}$. During a second rotation of the wheel 102, the measurement unit 130 may initialize the n slots with the angular widths $\Delta\theta_{i,i-1}^{(1)}$ determined from the spoke times $t_0^{(1)}, t_1^{(1)}, \ldots, t_{n-1}^{(1)}, t_0^{(2)}$ measured during the first rotation. During a third rotation of the wheel 102, the measurement unit 130 may update the n slots with a set of new angular widths $\Delta\theta_{i,i-1}^{(2)}$ determined from the spoke times $t_0^{(2)}, t_1^{(2)}, \ldots, t_{n-1}^{(2)}, t_0^{(3)}$ measured during the second rotation. Each new angular width $\Delta\theta_{i,i-1}^{(2)}$ may be averaged with the existing value stored in the corresponding memory slot to create a running average $\Delta\overline{\theta}_{i,i-1}$. This averaging may be weighted such that each new angular width $\Delta\theta_{i,i-1}$ contributes less to the running average as the number of rotations increases.

To account for angular acceleration of the wheel 102 during a single rotation, the n time intervals $\Delta t_{i,i-1}$ can be fitted to a linear model (e.g., via linear regression). Even when the spokes 101 are not uniformly spaced, the time intervals $\Delta t_{i,i-1}$ will still, on average, trend to a zero-slope line when the wheel 102 rotates at a constant angular velocity ω. If the wheel 102 accelerates, the time intervals $\Delta t_{i,i-1}$ will become progressively shorter during the rotation, giving rise to a fitted slope that is non-zero. Based on the fitted slope, the time intervals $\Delta t_{i,i-1}$ can be corrected to remove the angular acceleration, thereby removing the effects of the acceleration. These corrected time intervals may then be combined with the running average, as described above. The time intervals $\Delta t_{i,i-1}$ may be alternatively fitted to another type of model (e.g., non-linear) without departing from the scope hereof.

After several rotations of the wheel 102, the running averages $\Delta\overline{\theta}_{i,i-1}$ stored in the memory 160 may be used to determine the angular velocity ω. Specifically, for a subsequently measured time interval $\Delta t_{i,i-1}$, the corresponding angular velocity is $\omega=\Delta\overline{\theta}_{i,i-1}/\Delta t_{i,i-1}$. The angular velocity ω may be multiplied by a radius r of the wheel 102 to obtain a corresponding linear velocity $v=r\omega$. As shown in FIG. 7, the measurement unit 130 may then output the angular velocity ω. In one embodiment, the angular velocity ω is outputted to a bicycle computer, speedometer, or personal electronics device (e.g., smartphone) that displays the angular velocity ω and/or linear velocity v.

Advantageously, the angular velocity ω can be determined for every pair of neighboring spokes 101, and thus can be updated several times during a single rotation of the wheel 102 (e.g., thirty-two times in the case of the wheel 102 shown in FIG. 7). Thus, the present embodiments can determine the angular velocity significantly faster than the once-per-rotation update rates used for prior-art bicycle computers and speedometers. Similarly, the rapid determination and updating of the angular velocity ω allows an angular acceleration α of the wheel 102 to also be quickly determined. Accordingly, the present embodiments can be used to measure variations in the angular acceleration a that occur on time scales less than the time T of a single rotation. This includes measurements of sinusoidal variations of α that are transmitted to the wheel 102 (e.g., via a chain and cassette) during pedaling.

In some embodiments, the light source 104 and spoke sensing device 100 are mounted directly to a bicycle. For example, the light source 104 and spoke sensing device 100 may be mounted to chain stays that straddle a rear wheel of the bicycle, seat stays that straddle the rear wheel, or fork blades that straddle a front wheel of the bicycle. In any case, the light source 104 and spoke sensing device 100 are arranged such that the light source 104 emits the photo-interrupter beam 103 through the rotational plane of the wheel 102 and into the spoke sensing device 100. In these embodiments, the angular velocity ω can be determined without requiring the bicycle to be operated in a stationary trainer (e.g., as shown in FIG. 4). Accordingly, the embodiment can be used similarly to prior-art bicycle computers and speedometers, but with the advantage of a faster update rate.

While the above description presents the spoke sensing device 100 as a photodetector that detects the photo-interrupter beam 103 emitted by the light source 104, the spoke sensing device 100 may be another type of sensor for detecting proximity of a spoke 101 without departing from the scope hereof. For example, each spoke 101 may have a magnet attached thereto, wherein the spoke sensing device 100 can be a magnetic-field sensor (e.g., a Hall effect sensor). Alternatively, when the spokes 101 are optically reflective (e.g., when made of metal), the photo-interrupter beam 103 can reflect off the spokes 101 into the photodetector. If the spokes 101 are not reflective (e.g., when coated of black anodized aluminum), optical reflectors can be mounted thereto. In these cases, the light source 104 can be placed on the same side of the wheel 102 (i.e., on the same side of the rotational plane) as the photodetector. Furthermore, the "dips" in the spoke-sensor signal S of FIG. 8 that indicate the presence of spokes will alternatively appear as "spikes" instead.

Figure 9:
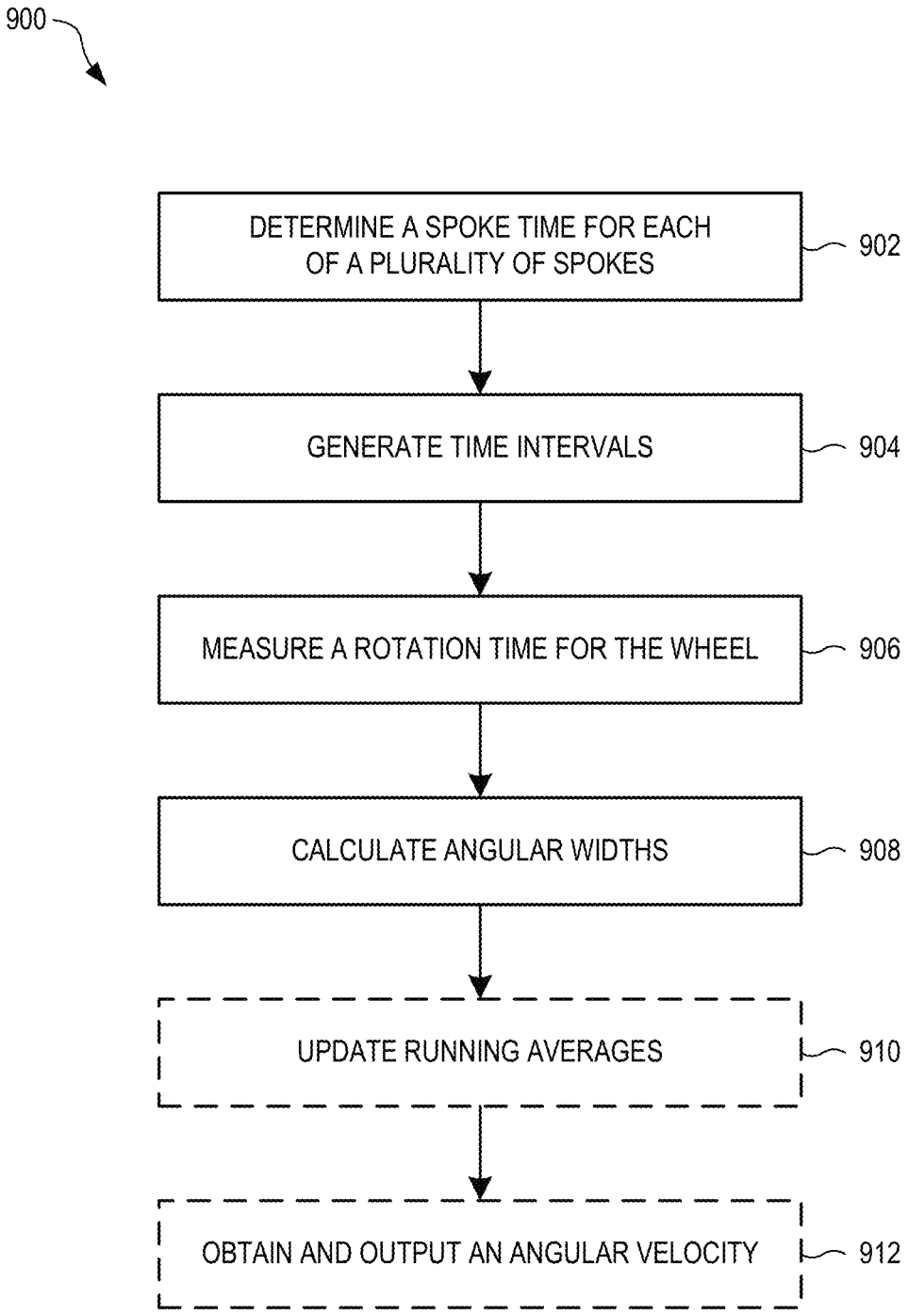
FIG. 9 is a flow chart of a method for measuring the angular velocity of a wheel, in embodiments.

FIG. 9 is a flow chart of a method 900 for measuring the angular velocity of a wheel. The method 900 may be implemented, for example, with the wheel 102 and measurement unit 130 shown in FIG. 7. In a block 902 of the method 900, a signal outputted by a spoke sensing device is processed to determine, for a full rotation of the wheel, a spoke time at which each of a plurality of spokes of the wheel is detected. In one example of the block 902, the spoke sensing device 100 includes a photodetector that detects the photo-interrupter beam 103 and outputs the spoke-sensing signal S to the measurement unit 130. The measurement unit 130 then processes the spoke-sensing signal S to determine the spokes time $t_i$.

In a block 904 of the method 900, a previous spoke time is subtracted from each spoke time to generate a plurality of time intervals. Each time interval indicates a time that has elapsed between detection of each pair of neighboring spokes of the plurality of spokes. In one example of the block 904, the measurement unit 130 calculates each time interval $\Delta t_{i,i-1}=t_i-t_{i-1}$ from the spoke times $t_i$ and $t_{i-1}$.

In a block 906 of the method 900, a rotation time for the wheel is measured. In one example of the block 906, the measurement unit 130 measures the rotation time T as the time required for the wheel 102 to complete a single full rotation, based on subsequent detections of the reference spoke 101(0).

In a block 908 of the method 900, a plurality of angular widths is calculated, based on the time intervals generated in the block 904, and based on the rotation time measured in the block 906. These angular widths identify a pattern of the plurality of spokes. In one example of the block 908, the measurement unit 130 divides each time interval $\Delta t_{i,i-1}$ by the rotation time T to obtain a corresponding angular width $\Delta\theta_{i,i-1}$.

The method 900 may include a block 910 in which a plurality of running averages are updated based on the angular widths calculated in the block 908. The running averages may be stored in a memory. In one example of the block 910, the measurement unit 130 stores running averages $\Delta\overline{\theta}_{i,i-1}$ in the memory 160, as shown in FIG. 7. The measurement unit 130 then updates the running averages $\Delta\overline{\theta}_{i,i-1}$ based on the most recent set of angular widths $\Delta\theta_{i,i-1}$ (i.e., those calculated during the most recent rotation of the wheel 102).

The method 900 may also include a block 912 in which each of the running averages is divided into the corresponding time interval to obtain an angular velocity for the time interval. The angular velocity may then be outputted. In one example of the block 912, the measurement unit 130 divides each measured time interval $\Delta t_{i,i-1}$ by the corresponding running average $\Delta\overline{\theta}_{i,i-1}$ to obtain a value for the angular velocity ω. The measurement unit 130 may then output the angular velocity ω.

Combination of Features

Features described above as well as those claimed below may be combined in various ways without departing from the scope hereof. The following examples illustrate possible, non-limiting combinations of features and embodiments described above. It should be clear that other changes and modifications may be made to the present embodiments without departing from the spirit and scope of this invention:

(A1) An angular velocity measurement system may include a spoke sensing device configured to be positioned adjacent to a rotatable wheel having a plurality of spokes, a processor, and a memory communicably coupled with the processor. The memory stores machine-readable instructions that, when executed by the processor, may control the angular velocity measurement system to (i) process a signal outputted by the spoke sensing device to determine, for a full rotation of the wheel, a spoke time at which each of the plurality of spokes is detected; (ii) subtract from each spoke time a previous spoke time to generate a plurality of time intervals, each of the plurality of time intervals indicating a time that has elapsed between detection of each pair of neighboring spokes of the plurality of spokes; (iii) measure a rotation time for the wheel to complete the full rotation; and (iv) calculate, based on the time intervals and the measured rotation time, a plurality of angular widths that identify a pattern of the plurality of spokes.

(A2) In the system denoted as (A1), the machine-readable instructions that, when executed by the processor, control the angular velocity measurement system to measure the rotation time for the wheel may include machine-readable instructions that, when executed by the processor, control the angular velocity measurement system to measure the rotation time as the time between subsequent detections of a reference spoke of the plurality of spokes.

(A3) In either one of the systems denoted (A1) and (A2), the machine-readable instructions that, when executed by the processor, control the angular velocity measurement system to calculate the plurality of angular widths may include machine-readable instructions that, when executed by the processor, control the angular velocity measurement system to divide each of the plurality of time intervals by the measured rotation time such that each of the plurality of angular widths represents a fraction of a single rotation subtended by a corresponding pair of neighboring spokes.

(A4) In any one of the systems denoted (A1) through (A3), the memory may be configured to store a plurality of running averages corresponding to the plurality of angular widths. The memory may also store additional machine-readable instructions that, when executed by the processor, control the angular velocity measurement system to update, for each rotation of the wheel, the running averages with the plurality of angular widths calculated for said each rotation of the wheel.

(A5) In the system denoted (A4), the machine-readable instructions that, when executed by the processor, control the angular velocity measurement system to update the running averages may include machine-readable instructions that, when executed by the processor, control the angular velocity measurement system to replace each of the running averages with a weighted sum of (i) said each of the running averages, and (ii) the corresponding one of the angular widths calculated for said each rotation of the wheel.

(A6) In either one of the systems denoted (A4) and (A5), the memory may store additional machine-readable instructions that, when executed by the processor, control the angular velocity measurement system to (i) divide each of the running averages into a corresponding one of the time intervals to obtain an angular velocity for said one of the time intervals; and (ii) output the angular velocity.

(A7) In any one of the systems denoted (A1) through (A6), the memory may store additional machine-readable instructions that, when executed by the processor, control the angular velocity measurement system to (i) fit the plurality of time intervals to a model to determine an acceleration of the wheel during the full rotation; and (ii) correct the plurality of time intervals, based on the model, to remove the effects of the acceleration. The machine-readable instructions that, when executed by the processor, control the angular velocity measurement system to calculate the plurality of angular widths may include machine-readable instructions that, when executed by the processor, control the angular velocity measurement system to calculate the plurality of angular widths based on the corrected time intervals.

(A8) In any one of the systems denoted (A1) through (A7), the spoke sensing device may include a light source configured to emit a light beam, and a photodetector configured to detect the light beam. Each of the plurality of spokes may then be detected when said each of the plurality of spokes blocks the light beam from the photodetector.

(A9) In the system denoted (A8), the light source and the photodetector may be configured for mounting to a bicycle frame such that the light beam passes through a rotational plane of the wheel and into the photodetector.

(A10) In the system denoted (A8), the light source and the photodetector may be configured for mounting to a stationary bicycle trainer such that the light beam passes through a rotational plane of the wheel and into the photodetector.

(B1) A method for measuring angular velocity of a wheel may include processing a signal outputted by a spoke sensing device to determine, for a full rotation of the wheel, a spoke time at which each of a plurality of spokes of the wheel is detected. The method may also include subtracting from each spoke time a previous spoke time to generate a plurality of time intervals, each of the plurality of time intervals indicating a time that has elapsed between detection of each pair of neighboring spokes of the plurality of spokes. The method may also include measuring a rotation time for the wheel to complete the full rotation. The method may also include calculating, based on the time intervals and the measured rotation time, a plurality of angular widths that identify a pattern of the plurality of spokes.

(B2) In the method denoted (B1), said measuring may include measuring the rotation time as the time between subsequent detections of a reference spoke of the plurality of spokes.

(B3) In either one of the methods denoted (B1) and (B2), said calculating the plurality of angular widths may include dividing each of the plurality of time intervals by the measured rotation time such that each of the plurality of angular widths represents a fraction of a single rotation subtended by a corresponding pair of neighboring spokes.

(B4) In any one of the methods denoted (B1) through (B3), the method may further include storing, in a memory, a plurality of running averages corresponding to the plurality of angular widths. The memory may also include updating, for each rotation of the wheel, the running averages with the plurality of angular widths calculated for said each rotation of the wheel.

(B5) In the method denoted (B4), said updating may include replacing each of the running averages with a weighted sum of (i) said each of the running averages, and (ii) the corresponding one of the angular widths calculated for said each rotation of the wheel.

(B6) In either one of the methods denoted (B4) and (B5), the method may further include dividing each of the running averages into a corresponding one of the time intervals to obtain an angular velocity for said one of the time intervals, and outputting the angular velocity.

(B7) In any one of the methods denoted (B1) through (B6), the method may further include fitting the plurality of time intervals to a model to determine an acceleration of the wheel during the full rotation, and correcting the plurality of time intervals, based on the model, to remove the effects of the acceleration. Said calculating the plurality of angular widths is based on the corrected time intervals.

(B8) In any one of the methods denoted (B1) through (B7), the spoke sensing device may include a light source configured to emit a light beam and a photodetector configured to detect the light beam. The method may further include positioning the light source and the photodetector on opposite sides of the wheel such that the light beam passes through a rotational plane of the wheel and into the photodetector.

(B9) In the method denoted (B8), the wheel may be connected to a bicycle frame. Said positioning may include mounting the light source and the photodetector to the bicycle frame.

(B10) In the method denoted (B8), the wheel may be connected to a bicycle mounted to a stationary bicycle trainer. Said positioning may include mounting the light source and the photodetector to the stationary bicycle trainer.

While various exemplary embodiments of the eddy current braking mechanism and control logic are shown in the drawings with reference to a bicycle, it should be understood that certain adaptations and modifications of the described exemplary embodiments may be made as construed within the scope of the present disclosure. Although the term "bicycle" is used, the invention relates equally to use in human-powered vehicles or cycles having one or more wheels. Therefore, the embodiments described above are considered to be illustrative and not restrictive.

What is claimed is:

1. An angular velocity measurement system, comprising:

a spoke sensing device configured to be positioned adjacent to a rotatable wheel having a plurality of spokes;

a processor; and a memory communicably coupled with the processor and storing machine-readable instructions that, when executed by the processor, control the angular velocity measurement system to:

process a signal outputted by the spoke sensing device to determine, for a full rotation of the wheel, a spoke time at which each of the plurality of spokes is detected;

subtract from each spoke time a previous spoke time to generate a plurality of time intervals, each of the plurality of time intervals indicating a time that has elapsed between detection of each pair of neighboring spokes of the plurality of spokes;

measure a rotation time for the wheel to complete the full rotation; and calculate, based on the time intervals and the measured rotation time, a plurality of angular widths that identify a pattern of the plurality of spokes.

2. The angular velocity measurement system of claim 1, wherein the machine-readable instructions that, when executed by the processor, control the angular velocity measurement system to measure the rotation time for the wheel include machine-readable instructions that, when executed by the processor, control the angular velocity measurement system to measure the rotation time as the time between subsequent detections of a reference spoke of the plurality of spokes.

3. The angular velocity measurement system of claim 1, wherein the machine-readable instructions that, when executed by the processor, control the angular velocity measurement system to calculate the plurality of angular widths include machine-readable instructions that, when executed by the processor, control the angular velocity measurement system to divide each of the plurality of time intervals by the measured rotation time such that each of the plurality of angular widths represents a fraction of a single rotation subtended by a corresponding pair of neighboring spokes.

4. The angular velocity measurement system of claim 1, wherein:

the memory is configured to store a plurality of running averages corresponding to the plurality of angular widths; and the memory stores additional machine-readable instructions that, when executed by the processor, control the angular velocity measurement system to update, for each rotation of the wheel, the running averages with the plurality of angular widths calculated for said each rotation of the wheel.

5. The angular velocity measurement system of claim 4, wherein the machine-readable instructions that, when executed by the processor, control the angular velocity measurement system to update the running averages include machine-readable instructions that, when executed by the processor, control the angular velocity measurement system to replace each of the running averages with a weighted sum of (i) said each of the running averages, and (ii) the corresponding one of the angular widths calculated for said each rotation of the wheel.

6. The angular velocity measurement system of claim 4, wherein the memory stores additional machine-readable instructions that, when executed by the processor, control the angular velocity measurement system to:

divide each of the running averages into a corresponding one of the time intervals to obtain an angular velocity for said one of the time intervals; and output the angular velocity.

7. The angular velocity measurement system of claim 1, wherein:

the memory stores additional machine-readable instructions that, when executed by the processor, control the angular velocity measurement system to:

fit the plurality of time intervals to a model to determine an acceleration of the wheel during the full rotation; and correct the plurality of time intervals, based on the model, to remove the effects of the acceleration; and the machine-readable instructions that, when executed by the processor, control the angular velocity measurement system to calculate the plurality of angular widths includes machine-readable instructions that, when executed by the processor, control the angular velocity measurement system to calculate the plurality of angular widths based on the corrected time intervals.

8. The angular velocity measurement system of claim 1, the spoke sensing device comprising:

a light source configured to emit a light beam; and a photodetector configured to detect the light beam;

wherein each of the plurality of spokes is detected when said each of the plurality of spokes blocks the light beam from the photodetector.

9. The angular velocity measurement system of claim 8, wherein the light source and the photodetector are configured for mounting to a bicycle frame such that the light beam passes through a rotational plane of the wheel and into the photodetector.

10. The angular velocity measurement system of claim 8, wherein the light source and the photodetector are configured for mounting to a stationary bicycle trainer such that the light beam passes through a rotational plane of the wheel and into the photodetector.

11. A method for measuring the angular velocity of a wheel, comprising:

processing a signal outputted by a spoke sensing device to determine, for a full rotation of the wheel, a spoke time at which each of a plurality of spokes of the wheel is detected;

subtracting from each spoke time a previous spoke time to generate a plurality of time intervals, each of the plurality of time intervals indicating a time that has elapsed between detection of each pair of neighboring spokes of the plurality of spokes;

measuring a rotation time for the wheel to complete the full rotation; and calculating, based on the time intervals and the measured rotation time, a plurality of angular widths that identify a pattern of the plurality of spokes.

12. The method of claim 11, wherein said measuring includes measuring the rotation time as the time between subsequent detections of a reference spoke of the plurality of spokes.

13. The method of claim 11, wherein said calculating the plurality of angular widths includes dividing each of the plurality of time intervals by the measured rotation time such that each of the plurality of angular widths represents a fraction of a single rotation subtended by a corresponding pair of neighboring spokes.

14. The method of claim 11, further comprising:

storing, in a memory, a plurality of running averages corresponding to the plurality of angular widths; and updating, for each rotation of the wheel, the running averages with the plurality of angular widths calculated for said each rotation of the wheel.

15. The method of claim 14, wherein said updating includes replacing each of the running averages with a weighted sum of (i) said each of the running averages, and (ii) the corresponding one of the angular widths calculated for said each rotation of the wheel.

16. The method of claim 14, further comprising:

dividing each of the plurality of running averages into a corresponding one of the time intervals to obtain an angular velocity for said one of the time intervals; and outputting the angular velocity.

17. The method of claim 11, further comprising:

fitting the plurality of time intervals to a model to determine an acceleration of the wheel during the full rotation; and correcting the plurality of time intervals, based on the model, to remove the effects of the acceleration;

wherein said calculating the plurality of angular widths is based on the corrected time intervals.

18. The method of claim 11, wherein:

the spoke sensing device includes a light source configured to emit a light beam and a photodetector configured to detect the light beam; and the method further comprises positioning the light source and the photodetector on opposite sides of the wheel such that the light beam passes through a rotational plane of the wheel and into the photodetector.

19. The method of claim 18, wherein:

the wheel is connected to a bicycle frame; and said positioning includes mounting the light source and the photodetector to the bicycle frame.

20. The method of claim 18, wherein:

the wheel is connected to a bicycle mounted to a stationary bicycle trainer; and said positioning includes mounting the light source and the photodetector to the stationary bicycle trainer.

* * * * *